US009108328B2

(12) United States Patent
Kneier

(10) Patent No.: US 9,108,328 B2
(45) Date of Patent: Aug. 18, 2015

(54) SHAVING DEVICE WITH A PAD

(71) Applicant: Brian Eugene Kneier, Sun Valley, CA (US)

(72) Inventor: Brian Eugene Kneier, Sun Valley, CA (US)

( * ) Notice: Subject to any disclaimer, the term of this patent is extended or adjusted under 35 U.S.C. 154(b) by 0 days.

(21) Appl. No.: 14/201,675

(22) Filed: Mar. 7, 2014

(65) Prior Publication Data

US 2014/0182134 A1 Jul. 3, 2014

Related U.S. Application Data

(63) Continuation of application No. 13/049,866, filed on Mar. 16, 2011, now Pat. No. 8,707,561.

(60) Provisional application No. 61/349,992, filed on May 31, 2010.

(51) Int. Cl.

| | |
|---|---|
| ***B26B 21/40*** | (2006.01) |
| ***B26B 19/42*** | (2006.01) |
| ***B26B 21/14*** | (2006.01) |
| ***B26B 21/52*** | (2006.01) |

(52) U.S. Cl.

CPC ..... *B26B 21/40* (2013.01); *B26B 19/42* (2013.01); *B26B 21/4018* (2013.01); *B26B 21/52* (2013.01)

(58) Field of Classification Search

CPC .... B26B 19/42; B26B 21/4018; B26B 21/40; B26B 21/52

USPC ..... 30/34.2, 50, 527, 531, 532, 47, 77, 526, 30/528, 48

See application file for complete search history.

(56) References Cited

U.S. PATENT DOCUMENTS

| | | | |
|---|---|---|---|
| 2,164,820 | A | 7/1939 | Jean |
| 2,600,880 | A | 6/1952 | Karle |
| 2,670,534 | A | 3/1954 | Haber |
| 3,673,684 | A | 7/1972 | Muntz |
| 4,501,066 | A | 2/1985 | Sceberras |
| 4,780,959 | A | 11/1988 | Sinka |
| 4,831,731 | A | 5/1989 | Elits |
| 4,845,846 | A | 7/1989 | Sinka |
| 5,133,131 | A | 7/1992 | Hoffman |
| 5,146,680 | A | 9/1992 | Bakhos |
| D343,922 | S | 2/1994 | Ahlgren |
| 5,287,624 | A | 2/1994 | Mondo et al. |
| 5,426,853 | A | 6/1995 | McNinch |
| 5,630,275 | A | 5/1997 | Wexler |
| 6,434,828 | B1 | 8/2002 | Andrews |

(Continued)

OTHER PUBLICATIONS http://www.gadgetking.com/2009/01/13/rolling-razor-dual-head; Rolling Razor Dual Head Shaver—GadgetKing.com.

(Continued)

*Primary Examiner* — Ghassem Alie

(74) *Attorney, Agent, or Firm* — Patent Law Agency, LLC; Peter Ganjian

(57) ABSTRACT

The present invention provides a shaving device that includes a handle for better control, and a stand that has a pad with sufficient surface area to comfortably compress and frictionally grip to tighten skin in relation to the working plane of one or more blades of the shaving device for smoother shave. The stand tightens the skin for closer shave, and compresses it below a level of existing hair growth, causing the hair follicles to protrude for even a better and closer shave. The stand further pushes the skin away from in-between the razor heads to diminish cuts and nicks, all for a closer shave.

3 Claims, 9 Drawing Sheets

(56) References Cited

U.S. PATENT DOCUMENTS

| | | | | |
|---|---|---|---|---|
| 7,086,160 | B2 * | 8/2006 | Coffin et al. | 30/532 |
| 8,307,552 | B1 | 11/2012 | Drouillard | |
| 2002/0066186 | A1 | 6/2002 | White et al. | |
| 2007/0184011 | A1 | 8/2007 | Herlands | |
| 2010/0205808 | A1 | 8/2010 | King | |

OTHER PUBLICATIONS

U.S. Appl. No. 13/049,866 File History; Filed: Mar. 16, 2011.

* cited by examiner

SHAVING DEVICE WITH A PAD

CROSS-REFERENCE TO RELATED APPLICATIONS

This application is a DIVISIONAL application claiming the benefit of priority of the co-pending U.S. Non-Provisional Utility patent application Ser. No. 13/049,866, with the filing date 16 Mar. 2011, which claims the benefit of priority of the U.S. Utility Provisional Patent Application No. 61/349,992, filed 31 May 2010, the entire disclosures of each and all of which applications are expressly incorporated by reference in their entirety herein.

BACKGROUND OF THE INVENTION

1. Field of the Invention

This invention relates to shaving devices and, more particularly, to shaving devices with an independent stand that has a friction/compression pad for closer shave.

2. Description of Related Art

Conventional single or dual head shaving devices are well known and have been in use for a number of years. Regrettably, most conventional shaving devices with dual heads suffer from obvious disadvantages in that they continue to function, work, or perform in the same manner as those with a single-head with no improved advantage in terms of closer shave for the user for smoother shaved skin. That is, single or dual-head shaving devices require that the razors be pressed against the skin of the user and be moved in a single or opposite strokes, without further aiding in the tightening of the skin for closer shave. Accordingly, there really is no improvement in the shaving performance (i.e., closer shave) whether using a single or dual-head shaving device.

Therefore, in light of the current state of the art and the drawbacks to current dual-head shaving devices mentioned above, a need exists for an improved shaving device that would provide an additional skin-tightening member for a closer, smoother shaved skin.

BRIEF SUMMARY OF THE INVENTION

An exemplary optional aspect of the present invention provides a shaving device, comprising:

- a razor blade head having a pivot axis that includes razor blades;
- a stand that is independent and separate from the razor blade head, with the razor blade heads pivoting independent of and separate from the stand;
- the stand having sufficient surface area to comfortably compress and frictionally grip to tighten and firm skin in relation to a working plane of razor blade, and further, for compressing the skin below a level of existing hair growth, causing hair follicles to protrude, which enables closer shave of the skin hair.

Another exemplary optional aspect of the present invention provides a bi-directional shaving device, comprising:

- a plane of symmetry within which lies a principle longitudinal axis and an axis of symmetry, with the principle longitudinal axis perpendicular to the axis of symmetry;
- a short handle having a central longitudinal axis;
- a first and a second head structures that substantially vertically protrude from a top horizontal surface of the handle and include respective bottom ends coupled perpendicular therewith, with the top horizontal surface of the handle perpendicular to the plane of symmetry;

- the first and second head structures having a first side juxtaposed adjacent one another, facing the plane of symmetry, and include top divergent ends that diverge away from the plane of symmetry and that detachably accommodate respective first and second razor blade units;
- the first and second razor blade units are comprised of respective first and second razor blade heads that are pivotally coupled with respective first and second razor blade head connector structures along a pivot axis, which, in turn, detachably couple with the respective first and second head structures;
- the respective first and second razor blade heads having a first central longitudinal axis that is parallel the pivot axis and that is transverse the principle longitudinal axis when the respective first and second razor blade heads are coupled with the respective first and second head structures;
- the first and second razor blade heads include a respective set of first and second razor blades, with the set of first and second razor blades having sharp razor blade edges parallel the first central longitudinal axis, and pointed inwardly towards the plane of symmetry, while oriented at an acute angle relative to a working plane of the respective first and second razor blade heads, with the working plane substantially perpendicular to the plane of symmetry;
- a center stand that includes a pad with sufficient surface area to comfortably compress and frictionally grip to tighten skin in relation to the working plane of the first and second razor blade heads for smoother shave;
- the pad has a cross-sectional profile that includes lateral sides that protrude substantially vertical from a top surface of a base of the stand, and includes a substantially convex form-factor that extends in-between the lateral sides;
- the cross-sectional profile of the pad extends along a longitudinal axis of the pad, which is parallel the axis of symmetry;
- the center stand is an independent and separate part, and is positioned within the plane of symmetry in between the first side of the first and the second head structures, and substantially vertically protrudes from the top horizontal surface of the handle, and includes:
- the base on which the pad is coupled; and
- a support coupled with the base;
- the base is comprised of a base length that is oriented transverse the principle longitudinal axis with sufficient expanse that spans an entire distance parallel between a first and second distal ends of the first and second razor blade heads;
- the support is comprised of:
- a top distal end that is wider than a bottom distal end, having a height that elevates the pad substantially parallel and flush with the working plane of the first and second razor blade heads;
- the support is laterally reinforced with first and second braces at the top distal end, with the first and second braces coupled with a bottom surface of the base and top distal ends of lateral surfaces of the support.

Still another exemplary optional aspect of the present invention provides a bi-directional shaving device, wherein:

- the short handle includes:
- a grip portion that is configured substantially as a frustum of a right circular cone having a grip width that radially decreases along the central longitudinal axis of the handle commencing from a curved bottom surface of the grip portion and radially converging to a neck portion of the handle towards the plane of symmetry;

a barrier portion configured substantially as an inverted frustum of a right circular cone having a barrier width that radially increases along the central longitudinal axis of the handle commencing from the neck portion of the handle, with the barrier portion forming divergent, radially beveled flange wall of the top horizontal surface of the handle that radially extends away from the plane of symmetry;

the barrier portion limits and blocks a grip of fingertips to within the grip portion at the neck portion of the handle, the divergent, radially beveled flange wall oriented at an angle with sufficient span to prevent and block the fingertips to move passed beyond the neck portion.

A further exemplary optional aspect of the present invention provides a bi-directional shaving device, wherein:

the grip portion of the handle is arranged for manual grasp by the fingertips close to the pivoting first and second razor blade heads at the neck portion of the handle for greater control and feel in application of pressure parallel the principle longitudinal axis against the working plane, enabling a sense for additional stubble removal;

the grip portion enables moving the handle in a reciprocating motion so that the center stand and first and second razor blade heads are movable along the working plane on the skin, with the movement generally perpendicular to the applied pressure;

the center stand tightens the skin by a frictional pull on the skin as a result of the applied pressure, causing the skin to stretch and tighten to enable a trailing one of the first and second razor blade heads for closer shave;

the center stand further compresses the skin as a result of the applied pressure, compressing the skin below a level of existing hair growth, causing hair follicles to protrude, which enables closer shave of the skin hair; and the center stand substantially fills a gap between the first and second razor blade heads to keep the skin flat and away from being caught and wedged in between the first and second razor blade heads to thereby diminish potential of cuts and nicks, especially during directional change;

whereby the center stand enable rapid back and forth slide of the first and second razor blade heads along the working plane of the skin in opposite short strokes, while maintaining the skin tight, the skin hair raised in a perpendicular orientation in relation to the working plane, and the skin flat to diminish cuts and nicks when changing shaving direction.

Another exemplary optional aspect of the present invention provides a bi-directional shaving device, wherein:

the central longitudinal axis of the handle is parallel the principle longitudinal axis.

Still another exemplary optional aspect of the present invention provides a bi-directional shaving device, wherein:

the central longitudinal axis of a grip portion of the handle is at an angle with a barrier portion central longitudinal axis.

An exemplary optional aspect of the present invention provides a stand, comprising:

a stand that includes a pad with sufficient surface area to comfortably compress and frictionally grip to tighten skin in relation to a working plane of a first and second razor blade heads for smoother shave;

the pad has a cross-sectional profile that includes lateral sides that protrude substantially vertical from a top surface of a base of the stand, and includes a substantially convex form-factor that extends in-between the lateral sides;

the cross-sectional profile of the pad extends along a longitudinal axis of the pad;

the stand includes:

the base on which the pad is coupled; and a support coupled with the base;

the base is comprised of a base length that with sufficient expanse that spans an entire distance parallel between a first and second distal ends of the first and second razor blade heads;

the support is comprised of:

a top distal end that is wider than a bottom distal end, having a height that elevates the pad substantially parallel and flush with the working plane of the first and second razor blade heads;

the support is laterally reinforced with first and second braces at the top distal end, with the first and second braces coupled with a bottom surface of the base and top distal ends of lateral surfaces of the support.

Another exemplary optional aspect of the present invention provides a bi-directional shaving device, comprising:

a plane of symmetry within which lies a principle longitudinal axis and an axis of symmetry, with the principle longitudinal axis perpendicular to the axis of symmetry;

a short handle having a central longitudinal axis;

a first and second razor blade heads pivotally coupled with the handle along a pivot axis, and include a respective set of first and second razor blades, with the set of first and second razor blades having sharp razor blade edges parallel the axis of symmetry, and pointed inwardly towards the plane of symmetry, while oriented at an acute angle relative to a working plane of the respective first and second razor blade heads, with the working plane substantially perpendicular to the plane of symmetry;

a center stand that includes a pad with sufficient surface area to comfortably compress and frictionally grip to tighten skin in relation to the working plane for smoother shave;

the pad has a cross-sectional profile that includes a substantially convex form-factor that extends in-between a lateral sides of the pad, the cross-sectional profile of the pad extending along a longitudinal axis of the pad, which is parallel the axis of symmetry;

the center stand is an independent and separate part, and is positioned within the plane of symmetry in between the first and second razor blade heads, and includes:

the base on which the pad is coupled; and a support coupled with the base;

the base is comprised of a base length that is oriented transverse the principle longitudinal axis with sufficient expanse that spans an entire distance parallel between a first and second distal ends of the first and second razor blade heads;

the support is comprised of:

a top distal end that is wider than a bottom distal end, having a height that elevates the pad substantially parallel and flush with the working plane, above the pivot axis;

the support is laterally reinforced with first and second braces at the top distal end, with the first and second braces coupled with a bottom surface of the base and top distal ends of lateral surfaces of the support.

Yet another exemplary optional aspect of the present invention provides a bi-directional shaving device, wherein:

the short handle includes:

a grip portion having a grip width that radially decreases along the central longitudinal axis of the handle, radially converging to a neck portion of the handle;

a barrier portion having a barrier width that radially increases along the central longitudinal axis of the handle, forming divergent, radially beveled flange wall;

the barrier portion limits and blocks a grip of fingertips at the neck portion of the handle to prevent and block the fingertips to move passed beyond the neck portion.

A further exemplary optional aspect of the present invention provides a bi-directional shaving device, wherein:

the grip portion of the handle is arranged close to the pivoting first and second razor blade heads at the neck portion for greater control and feel in application of pressure parallel the principle longitudinal axis against the working plane, enabling a sense for additional stubble removal;

the grip portion enables moving the handle in a reciprocating motion so that the center stand and first and second razor blade heads are movable along the working plane on the skin, with the movement generally perpendicular to the applied pressure;

the center stand tightens the skin by a frictional pull on the skin as a result of the applied pressure, causing the skin to stretch and tighten to enable a trailing one of the first and second razor blade heads for closer shave;

the center stand further compresses the skin as a result of the applied pressure, compressing the skin below a level of existing hair growth, causing the hair follicles to protrude, which enables closer shave of the skin hair; and the center stand substantially fills a gap between the first and second razor blade heads to keep the skin flat and away from being caught and wedged in between the first and second razor blade heads to thereby diminish potential of cuts and nicks, especially during directional change;

whereby the center stand enable rapid back and forth slide of the first and second razor blade heads along the working plane of the skin in opposite short strokes, while maintaining the skin tight, the skin hair raised in a perpendicular orientation in relation to the working plane, and the skin flat to diminish cuts and nicks when changing shaving direction.

Another exemplary optional aspect of the present invention provides a shaving device, comprising:

an elongated handle having a central longitudinal axis;

a razor blade head pivotally coupled with the elongated handle along a pivot axis, and includes a set of razor blades, with the set of razor blades having sharp razor blade edges oriented at an acute angle relative to a working plane of the respective the razor blade head, with the working plane at an angle to the central longitudinal axis;

a stand that includes a pad with sufficient surface area to comfortably compress and frictionally grip to tighten skin in relation to the working plane for smoother shave;

the pad has a cross-sectional profile that includes a substantially convex form-factor that extends in-between a lateral sides of the pad, the cross-sectional profile of the pad extending along a longitudinal axis of the pad;

the stand is an independent and separate part, and is positioned adjacent the razor blade heads, and includes:

a base on which the pad is coupled; and a support coupled with the base;

the base is comprised of a base length that is oriented transverse the central longitudinal axis with sufficient expanse that spans an entire distance parallel between a first and second distal ends of the razor blade head;

the support is comprised of:

a top distal end that is wider than a bottom distal end, having a height that elevates the pad substantially parallel and flush with the working plane, above the pivot axis;

the support is laterally reinforced with first and second braces at the top distal end, with the first and second braces coupled with a bottom surface of the base and top distal ends of lateral surfaces of the support.

Yet another exemplary optional aspect of the present invention provides a shaving device, wherein:

the stand tightens the skin by a frictional pull on the skin as a result of the applied pressure, causing the skin to stretch and tighten to enable the razor blade head for closer shave;

the stand further compresses the skin as a result of the applied pressure, compressing the skin below a level of existing hair growth, causing the hair follicles to protrude, which enables closer shave of the skin hair.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

The present invention provides a shaving device that has a multi-purpose pad mounted adjacent to a swiveling shaving head (or in-between two swiveling shaving heads) that allows a user to shave more closely than by conventional devices. The pad of the present invention functions as a "skin-tautening" agent to stretch and tighten or firm skin for close shave, and also as a "skin-compression" agent to compress the skin below the level of existing hair growth, causing the hair follicles to protrude, which enables a closer shave of the skin hair. The compression of the skin by the pad of the present invention also pushes the skin away from in between a dual-head shaving device so that the skin is not wedged or caught in-between the shaving heads, diminishing possible cuts and nicks. Therefore, the pad maintains the skin very tight and firm, the skin hair raised in a perpendicular orientation in relation to the working plane of a trailing razors, and the skin flat to diminish cuts and nicks when changing shaving direction (if a dual-head shaving device is used).

Figure 1B:
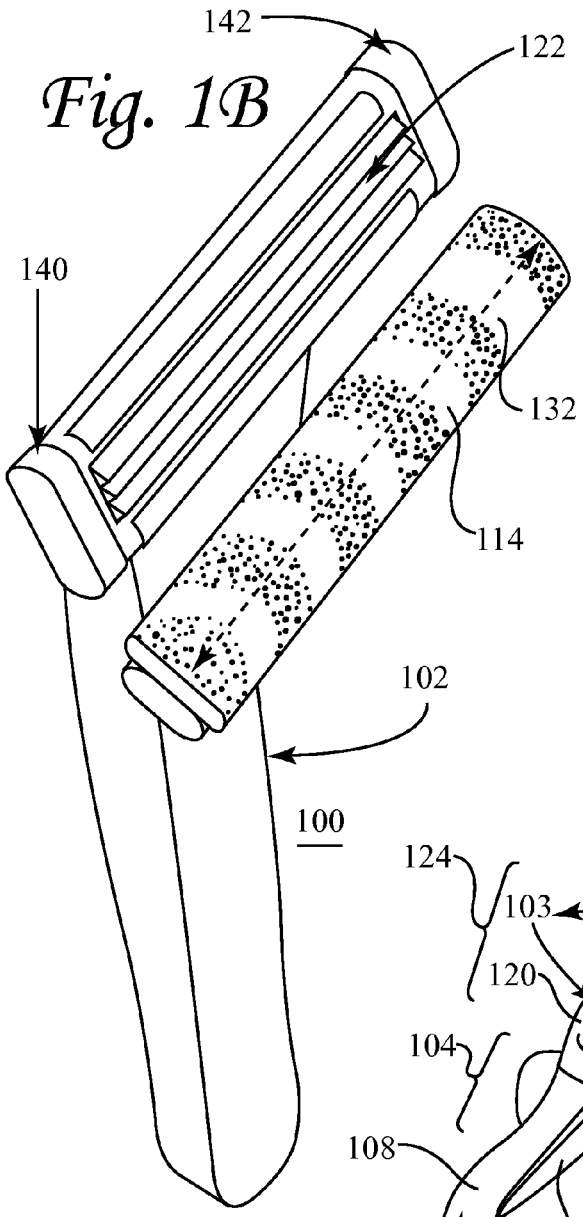
FIGS. 1A to 1C are exemplary illustrations of various views of a single-head shaving device using a friction/compression pad in accordance with the present invention.
Figure 1C:
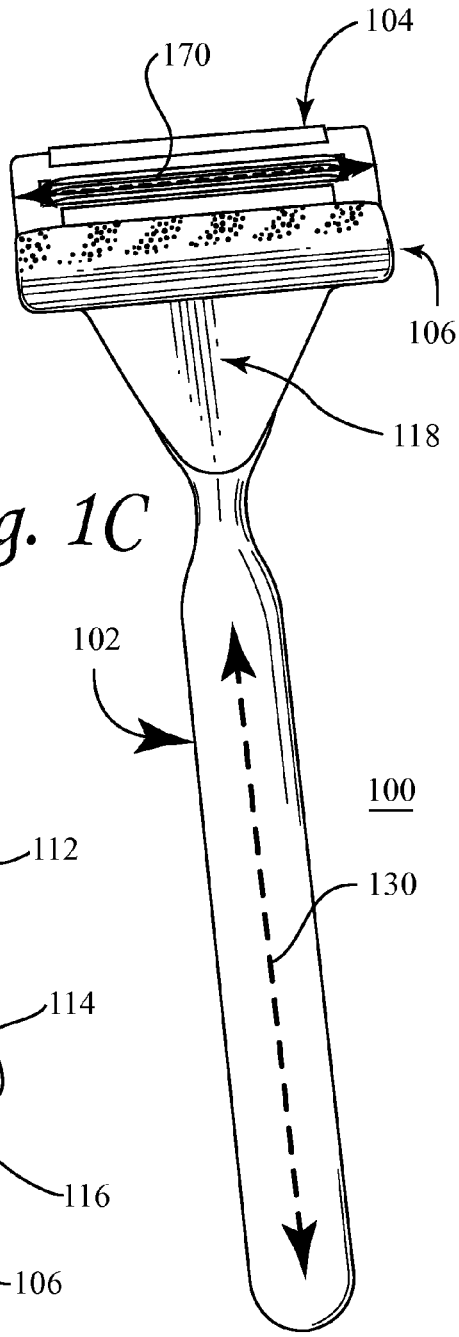
Figure 1A:
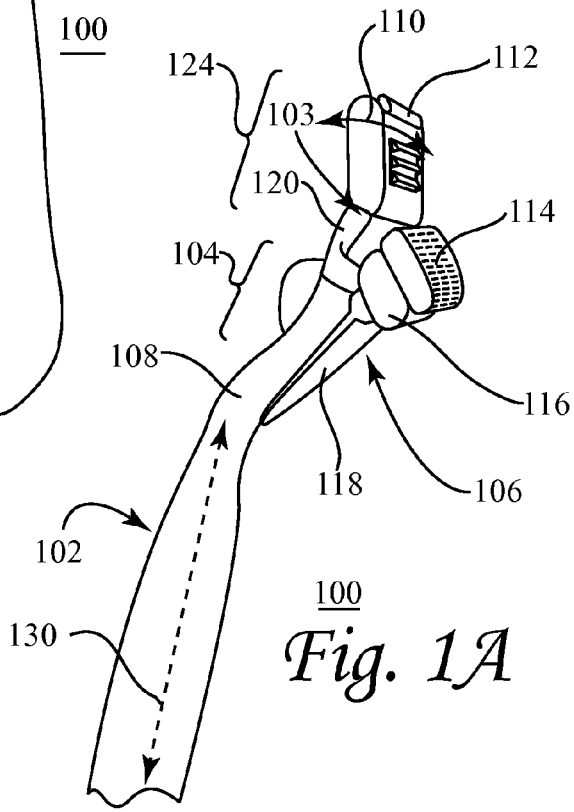

FIGS. 1A to 1C are exemplary illustrations of various views of a single-head shaving device using a friction/compression pad in accordance with the present invention. As illustrated, the shaving device 100 is comprised of a conventional handle 102 that has transition portion 108, and includes a conventional head structure 104 that accommodates a conventional, replaceable razor blade unit 124. The razor blade unit 124 is comprised of a conventional razor blade head 112 that is pivotally coupled with a razor blade head connector structure 120 along a pivot axis 103, which, in turn, is detachably couple with the head structure 104. This enables the head 112 to pivot along the reciprocating path indicated by the arrow 110. The razor blade head 112 has a first central longitudinal axis 170 that is parallel the pivot axis 103 and that is transverse a central longitudinal axis 130 of the handle 102 when the razor blade head 112 is coupled with the head structure 104. The razor blade head 112 includes a set of conventional razor blades 122 that have sharp razor blade edges parallel the first central longitudinal axis 170, while oriented at an acute angle relative to a working plane of the razor blade head 112. As further illustrated in the FIGS. 1A to 1C, the present invention provides a stand 106 that includes a pad 114 that has sufficient surface area to comfortably compress and frictionally grip to tighten (or firm) the skin in relation to the working plane of the razor head 112 for smoother shave.

Figure 2A:
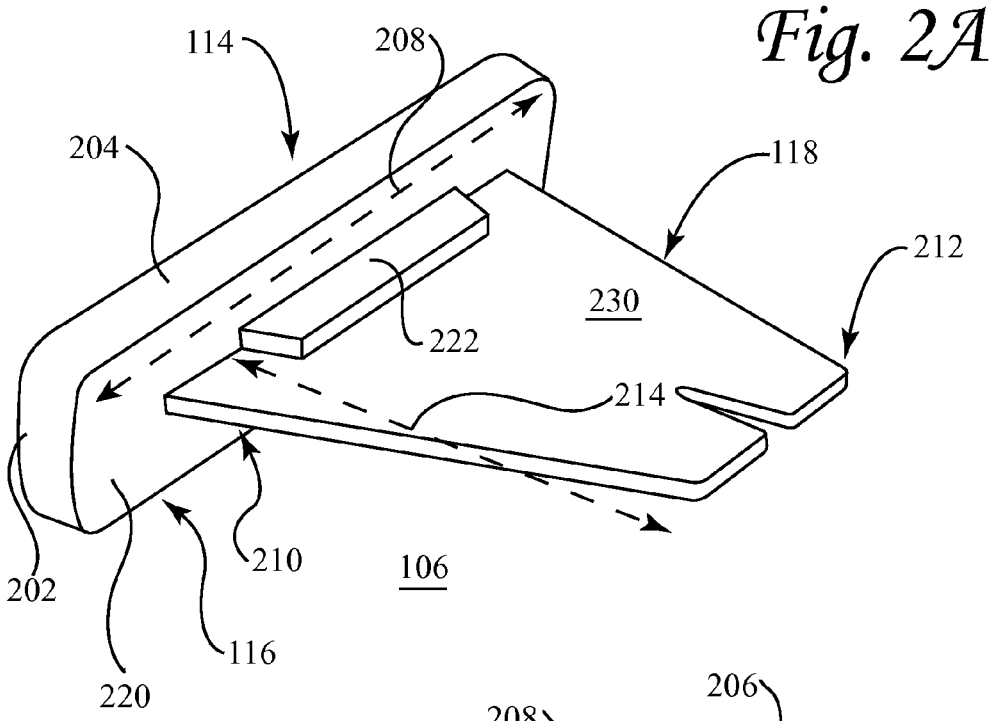
FIGS. 2A and 2B are exemplary illustrations of the various views of the stand illustrated in FIGS. 1A to 1C in accordance with the present invention.
Figure 2B:
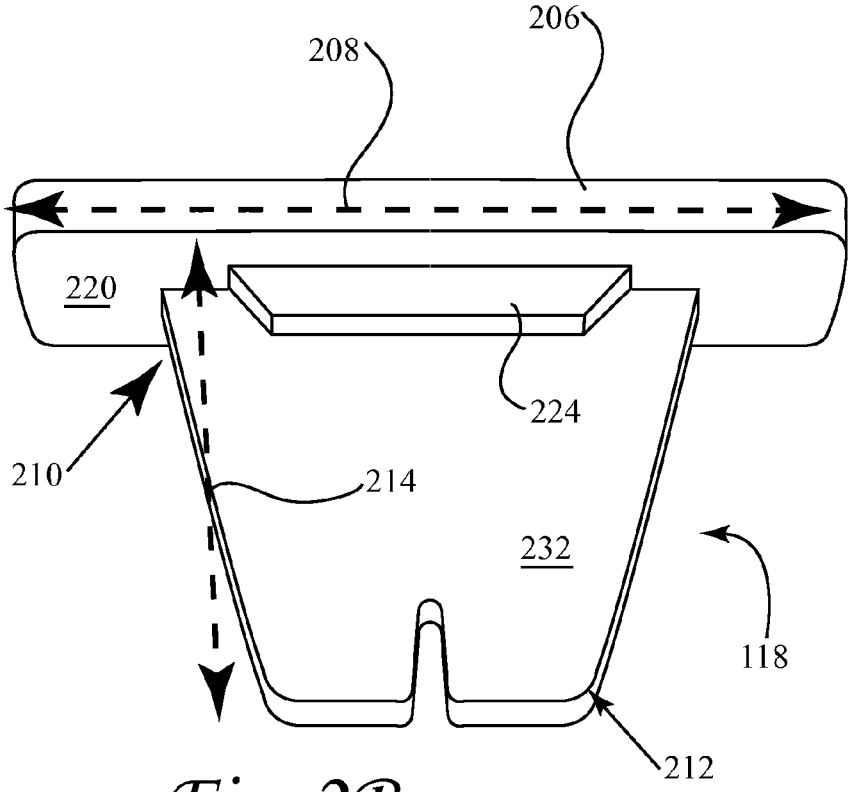

FIGS. 2A and 2B are exemplary illustrations of the various views of the stand illustrated in FIGS. 1A to 1C in accordance with the present invention. As illustrated in FIGS. 1A to 2B, the stand includes the pad 114 that has a cross-sectional profile 202 that includes a substantially convex form-factor that extends in-between the lateral sides 204 and 206 of the pad 114, with the cross-sectional profile 202 of the pad 114 extending along a longitudinal axis 132 (FIG. 1B) of the pad 114. The stand 106 is an independent and separate part, and is positioned adjacent the razor blade head 112. This enables the user to change the relative angle between the pad 114 and the razor blade head 112 by simply varying the angle of pressure of the device 100 on the skin surface being shaved. The stand 106 includes a base 116 on which the pad 114 is coupled. The stand 106 further includes a support 118 coupled with a bottom surface 220 of the base 116, with a lateral surface 230 of the support 118 coupled with the transitional portion 108 and head structure 104 sections of the single-head shaving device 100, enabling the razor blade head 112 to trail the pad 114 during shaving. The base 116 is comprised of a base length 208 that is oriented transverse the central longitudinal axis 130 with sufficient expanse that spans an entire distance parallel between a first and second distal ends 140 and 142 of the razor blade head 112. The support 118 is comprised of a top distal end 210 that is wider than a bottom distal end 212, having a height 214 that elevates the pad 114 substantially parallel and flush with the working plane (preferably above the pivot axis 103) of the razor blade head 112. The support 118 is laterally reinforced with first and second braces 222 and 224 at the top distal end 210, with respective first and second braces 222 and 224 coupled with the bottom surface 220 of the base 116 and top distal end 210 of lateral surfaces 230 and 232 of the support 118.

As best illustrated in FIGS. 1A to 1C, the stand 106 is positioned in front of a trailing razor blade head 112, and during shaving, the pad 114 is pressed against the skin independent of the razor blade head 112 to create a working plane for the razor head 112. The pad 114 is independently pressed against the skin and moved along the skin surface, which tightens and firms the skin by a frictional pull on the skin as a result of the applied pressure, causing the skin to stretch and tighten to a firm posture, creating a firm working plane for the trailing razor blade head 112 for a close shave. The stand 106 further compresses the skin as a result of the applied pressure, compressing the skin below the level of existing hair growth, causing the hair follicles to protrude, which enables closer shave of the skin hair. The working plane of the razor blade head 112 may be varied commensurate with the variations of the shaving surface area of the skin by simply varying the angle at which the handle 102 is held and also by the fact that the razor blade head 112 pivots about the pivot axis 103, along the path 110.

FIGS. 3A to 3E are exemplary illustrations of various views of a dual-head shaving device assembly using a friction/compression pad in accordance with the present invention. The dual-head shaving device includes similar corresponding or equivalent components, interconnections, and or cooperative relationships as the single-head shaving device 100 that is shown in FIGS. 1A to 2B, and described above. Therefore, for the sake of brevity, clarity, convenience, and to avoid duplication, the general description of FIGS. 3A to 3E will not repeat every corresponding or equivalent component and or interconnections that has already been described above in relation to the single-head shaving device 100 that is shown in FIGS. 1A to 2C.

Figure 3A:
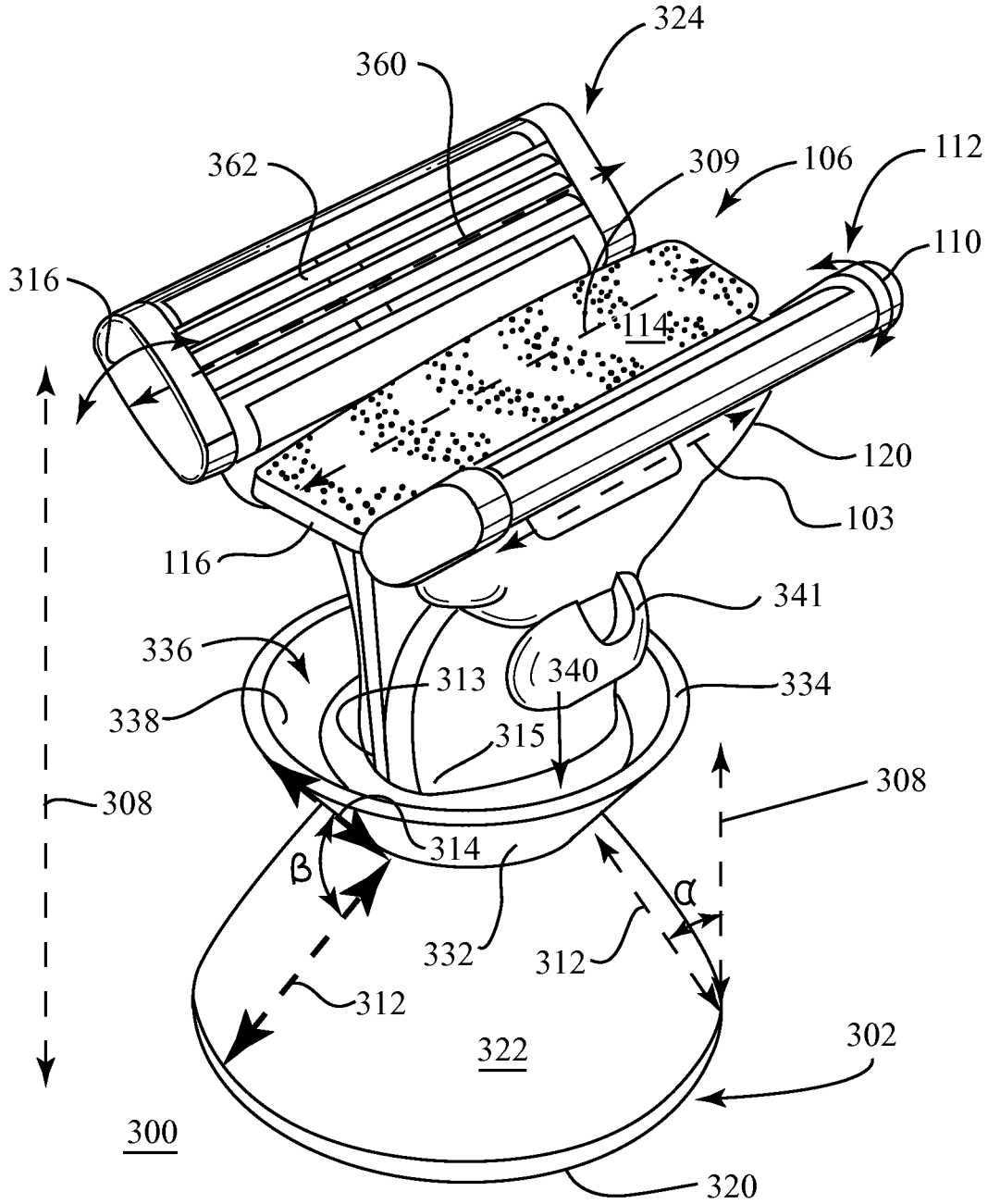
FIGS. 3A to 3E are exemplary illustrations of the various views of a dual-head shaving device assembly using a friction/compression pad in accordance with the present invention.
Figure 3B:
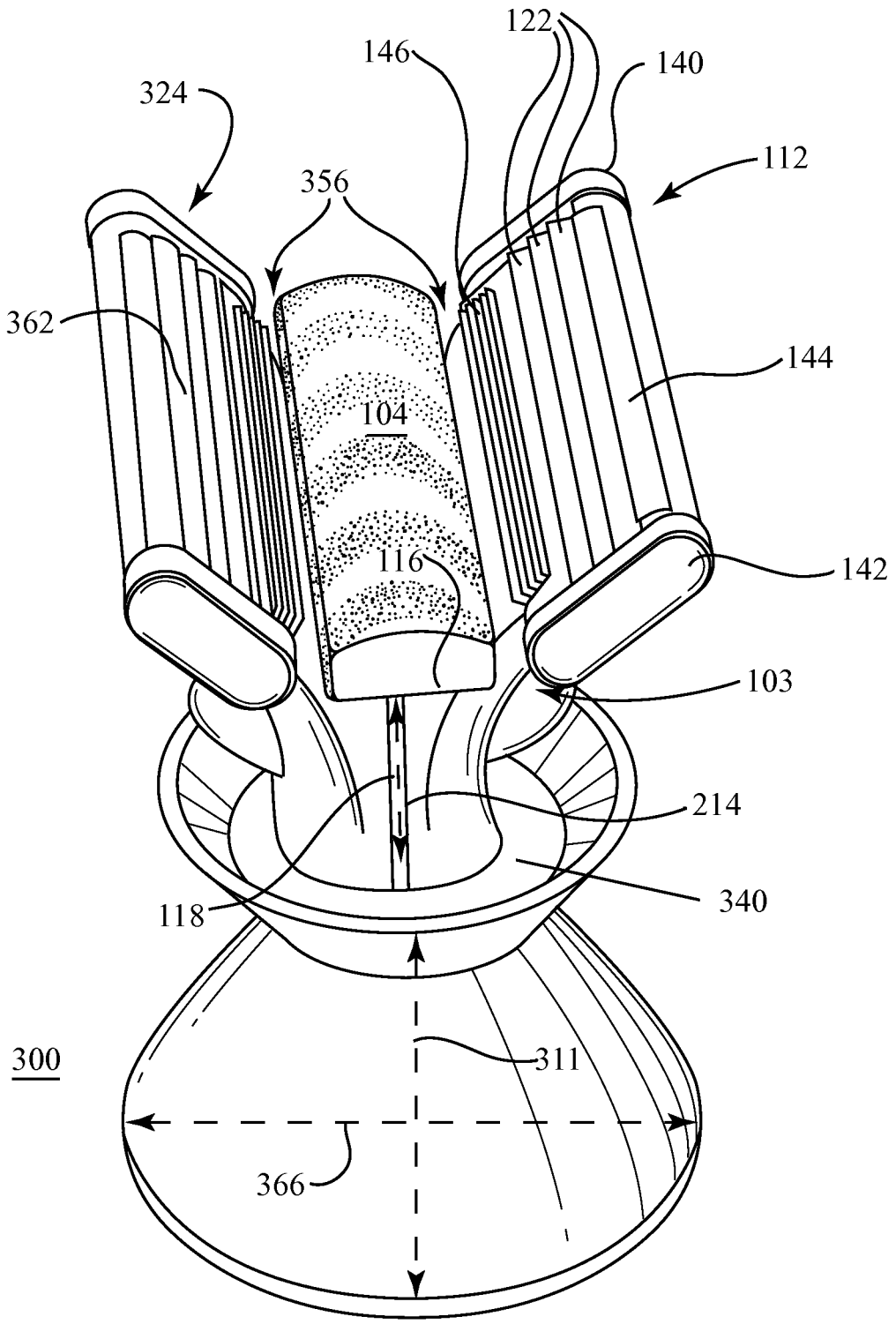
Figure 3C:
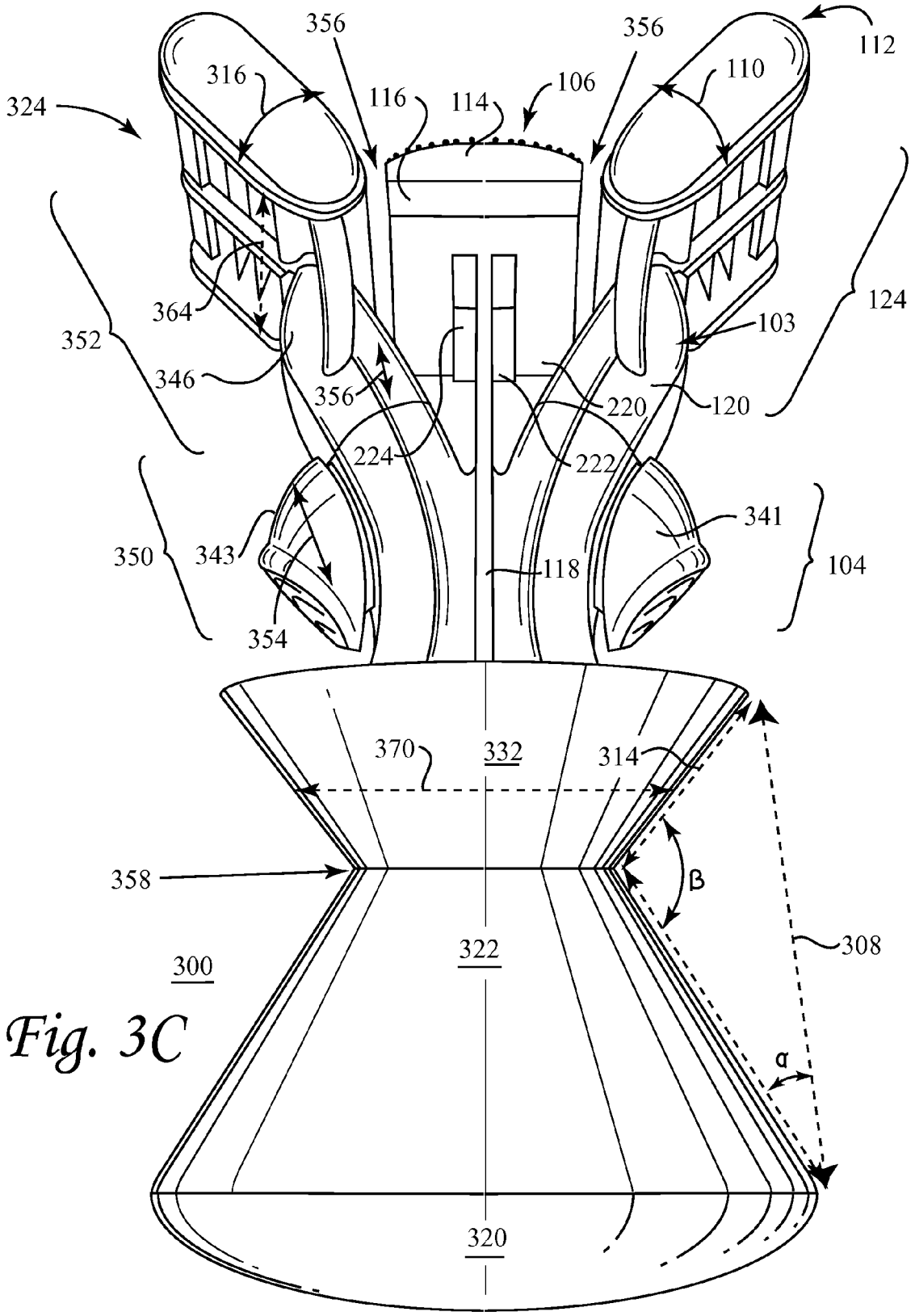
Figure 3D:
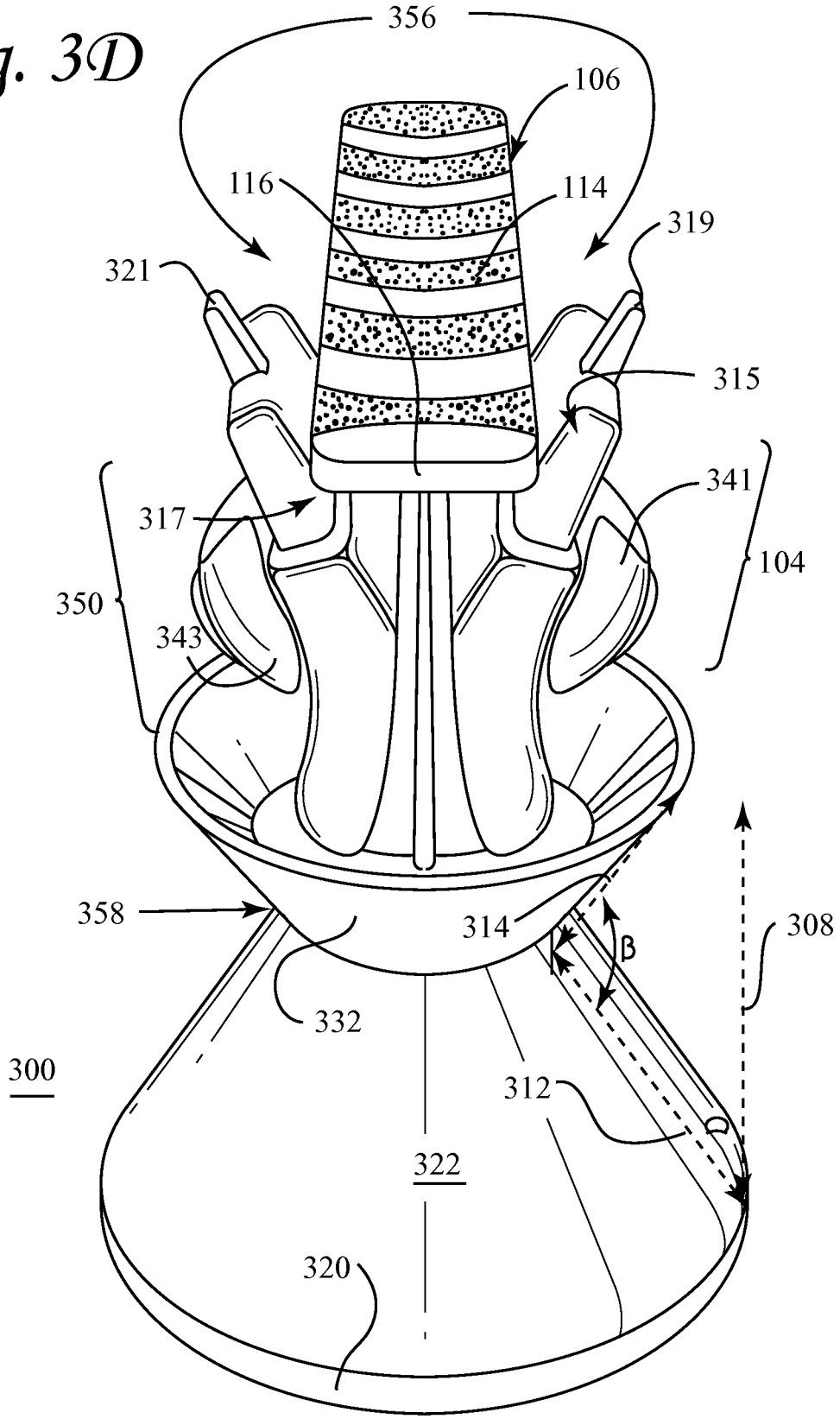
Figure 3E:
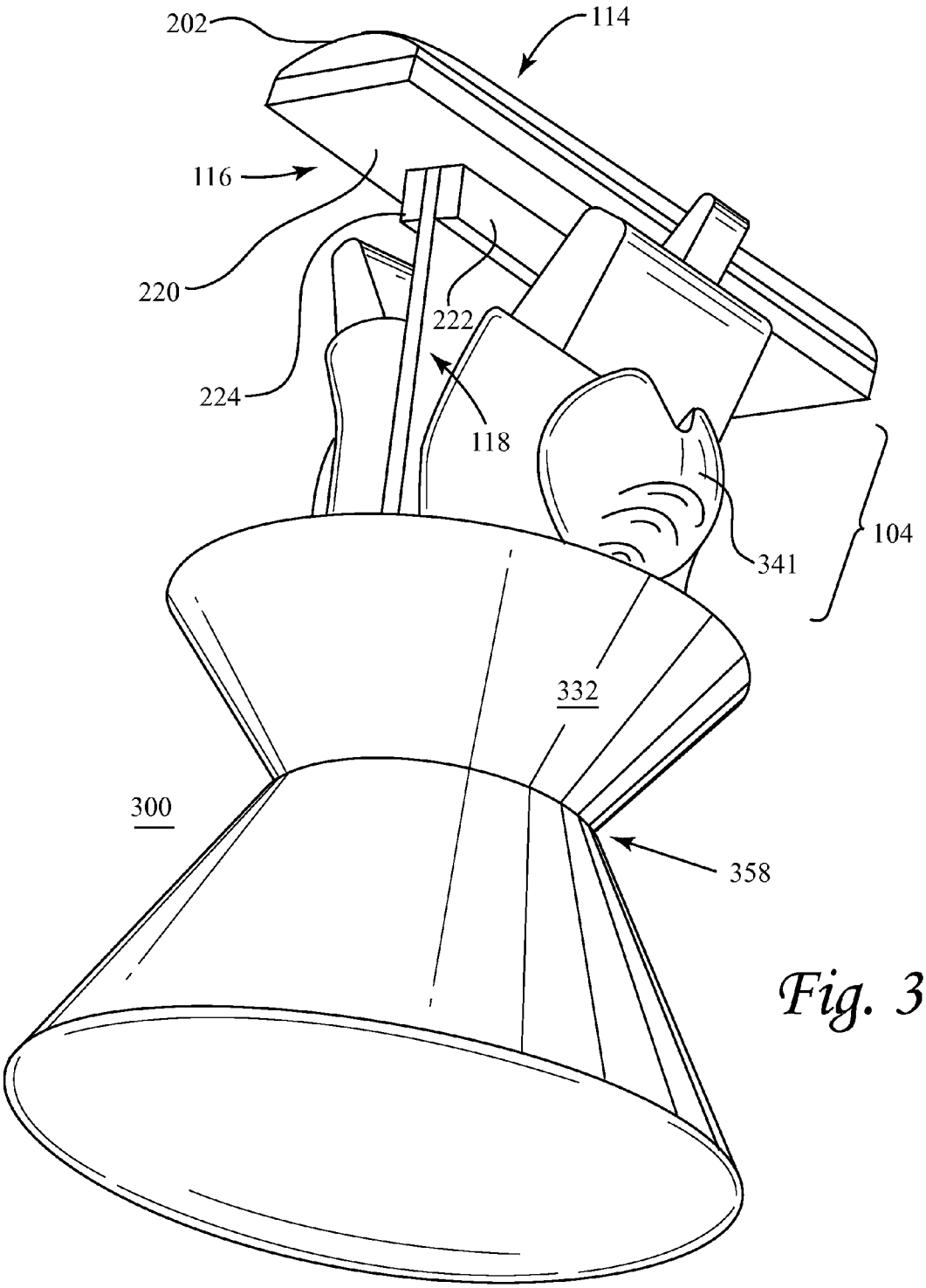

FIGS. 3A to 3E are exemplary illustrations of various views of a dual-head shaving device using a friction/compression pad while using a short handle in accordance with the present invention. As illustrated in FIGS. 3A to 3E, the present invention provides a dual-head shaving device 300 that has a plane of symmetry within which lays a principle longitudinal axis 308 and an axis of symmetry 309, with the principle longitudinal axis 308 perpendicular to the axis of symmetry 309. The plane of symmetry virtually passing through the longitudinal axis 132 of pad 114 (which parallels the axis of symmetry 309). In FIG. 3A, the illustrated axis of symmetry 309 shown on the pad 114 parallels and coincides (or overlaps) with the longitudinal axis 132 of the pad.

Referring to FIGS. 3A to 3E, further included with the dual-head shaving device 300 is a short handle 302 that has a central longitudinal axis 311. The dual-head shaving device 300 of the present invention includes a respective first and a second head structures 104 and 350 that substantially vertically protrude from a top horizontal surface 340 of the handle 302 and include respective bottom ends 313 and 315 coupled perpendicular therewith, with the top horizontal surface 340 of the handle 302 perpendicular to the plane of symmetry. The first and second head structures 104 and 350 having a first side 315 and 317 juxtaposed adjacent one another, facing the plane of symmetry, and include top divergent ends 319 and 321 that diverge away from the plane of symmetry and that detachably accommodate respective first and second razor blade units 124 and 352. The first and second razor blade units 124 and 352 are comprised of respective first and second razor blade heads 112 and 324 that are pivotally coupled with respective first and second razor blade head connector structures 120 and 346 along a pivot axis 103 and 364, which, in turn, detachably couple with the respective first and second head structures 104 and 350. The connector structures 120 and 346 detachably connect to the head structures 104 and 350 by conventional actuators 341 and 343 that that moved in the direction 354 to release the connector structures 120 and 346.

The respective first and second razor blade heads 112 and 324 have a first central longitudinal axis 170 and 360 that is parallel their respective pivot axis 103 and 364 and that is transverse the principle longitudinal axis 308 when the respective first and second razor blade heads 112 and 324 are coupled with the respective first and second head structures 104 and 350. The first and second razor blade heads 112 and 324 include a respective set of first and second razor blades 122 and 362, with the set of first and second razor blades 122 and 362 having sharp razor blade edges parallel the first central longitudinal axis 170 and 360, and pointed inwardly towards the plane of symmetry, while oriented at an acute angle relative to a working plane of the respective first and second razor blade heads 112 and 324, with the working plane substantially perpendicular to the plane of symmetry.

As further illustrated in FIGS. 3A to 3E, the present invention further provides a centered stand 106, the detailed structure of which is illustrated in FIGS. 2A and 2B, and described above. The stand 106 includes the pad 114 (best show in FIGS. 2A and 2B) with sufficient surface area to comfortably compress and frictionally grip to tighten skin in relation to the working plane of the first and second razor blade heads 112 and 324 for closer, smoother shave. The center stand 106 is an independent and separate part, and is positioned within the plane of symmetry in between the first sides 115 and 117 of the first and the second head structures 112 and 324, and substantially vertically protrudes from the top horizontal surface 340 of the handle 302. The center stand 106 includes the pad 114 that has a cross-sectional profile that includes lateral sides that protrude substantially vertical from the top surface of a base of the stand, and includes a substantially convex form-factor that extends in-between the lateral sides (FIGS. 2A and 2B). The cross-sectional profile of the pad 114 extends along a longitudinal axis 132 of the pad, which is parallel to the axis of symmetry 309. The centered stand 106 includes the base 116 on which the pad 114 is coupled, and has a support 118 coupled with the base 116. The base 116 is comprised of a base length 208 that is oriented transverse the principle longitudinal axis 308 with sufficient expanse that spans an entire distance parallel between a first and second distal ends 140 and 142 of the first and second razor blade heads 112 and 324.

The support 118 of the stand 106 is comprised of a top distal end 210 that is wider than a bottom distal end 212, having a height 214 that elevates the pad 114 substantially parallel and flush with the working plane of the first and second razor blade heads 112 and 324 (preferably above the pivot axis 103 and 364) of the first and second razor blade heads 112 and 324. The support 118 of the stand 106 is laterally reinforced with first and second braces 222 and 224 at the top distal end 210, with the first and second braces 222 and 224 coupled with a bottom surface 220 of the base 116 and top distal ends 210 of lateral surfaces 230 and 232 of the support 118.

The short handle 302 of the bi-directional shaving device 300 includes a grip portion 322 that is configured substantially as a frustum of a right circular cone having a grip width 366 that radially decreases along the central longitudinal axis 311 of the handle 302 commencing from a curved bottom surface 320 of the grip portion 322 and radially converging to a neck portion 358 of the handle 302 towards the plane of symmetry. In other words, the grip portion 322 has a radial slant or slope along the indicated line 312 at an angle $\alpha$ in relation to the principle longitudinal axis 308, converging at the neck portion 358.

The handle 302 of the bi-directional shaving device 300 further includes a barrier portion 332 configured substantially as an inverted frustum of a right circular cone having a barrier width 370 that radially increases along the central longitudinal axis 311 of the handle 302 commencing from the neck portion 358 of the handle 302, with the barrier portion 332 forming divergent, radially beveled flange 334 defining a radial wall 338 of the top horizontal surface 340 of the handle 302 that radially extends away from the plane of symmetry, forming a bowl-like concaved interior structure 336. In other words, the barrier portion 332 has a radial slant or slope along the indicated line 314 at an angle $\beta$ in relation to the radial slant or slop along the indicated line 312 of the grip portion. The barrier portion 332 limits and blocks a grip of fingertips to within the grip portion 322 at the neck portion 358 of the handle 302, the divergent, radially beveled flange 334 defining the radial wall 338 oriented at an angle with sufficient span to prevent and block the fingertips to move passed beyond the neck portion 358.

The grip portion 322 of the handle 302 is arranged for manual grasp by the fingertips close to the pivoting first and second razor blade heads 112 and 324 at the neck portion 358 of the handle 302 for greater control and feel in application of pressure parallel the principle longitudinal axis 308 against the working plane of the blade heads 112 and 324, enabling a sense for additional stubble removal. The grip portion 322 enables moving the handle in a reciprocating motion so that the centered stand 106 and first and second razor blade heads 112 and 324 are movable along the working plane on the skin, with the movement generally perpendicular to the applied pressure. The centered stand 106 tightens the skin by a frictional pull on the skin as a result of the applied pressure, causing the skin to stretch and tighten to enable a trailing one of the first and second razor blade heads 112 and 324 (depending on the directional move) for closer shave. The centered stand 106 further compresses the skin against the working plane or surface of the skin as a result of the applied pressure, compressing the skin below the level of existing hair growth, causing the hair follicles to protrude, which enables closer shave of the skin hair. In addition, the centered stand 106 substantially fills a gap 356 between the first and second razor blade heads 112 and 324 to keep the skin flat and away from being caught and wedged in between the first and second razor blade heads to thereby diminish potential of cuts and nicks, especially during directional change. Accordingly, the centered stand 106 enable rapid back and forth slide of the first and second razor blade heads 112 and 324 along the working plane of the skin in opposite short strokes (or in a back-and-forth "scrubbing fashion"), while maintaining the skin tight, compressing the skin to force hair follicles to protrude, and the skin flat to diminish cuts and nicks when changing shaving direction.

In general, the quick back-and-forth motion or the scrub-action of the device 300 against a users skin enables the user to feel and be aware of the areas requiring more shaving due to the "scraping sound" made when the blades contact stubble. In other words, if scraping sound is heard, the razors are still removing stubble. The short handle enables the user to have a grip of the device that is closer to the shaving heads, which provides for greater control, which is important in applying the right pressure to the shaving heads, changing directions quickly, and in making small changes to the angle of the blade to the skin while using the "scrubbing" motion. The wide grip portion 322 accommodates the user to easily apply pressure and provides control to the shaving heads while the narrow waist or neck section 358 accommodates user fingertips. The configuration of the handle enables the user to grip the handle from any angle by the fingertips or between the folded forefingers and thumb, which facilitates the user of scrubbing action when shaving. The ability of the user to apply pressure easily and with control is crucial to the skin-tautening feature, which allows for a closer shave.

Figure 4:
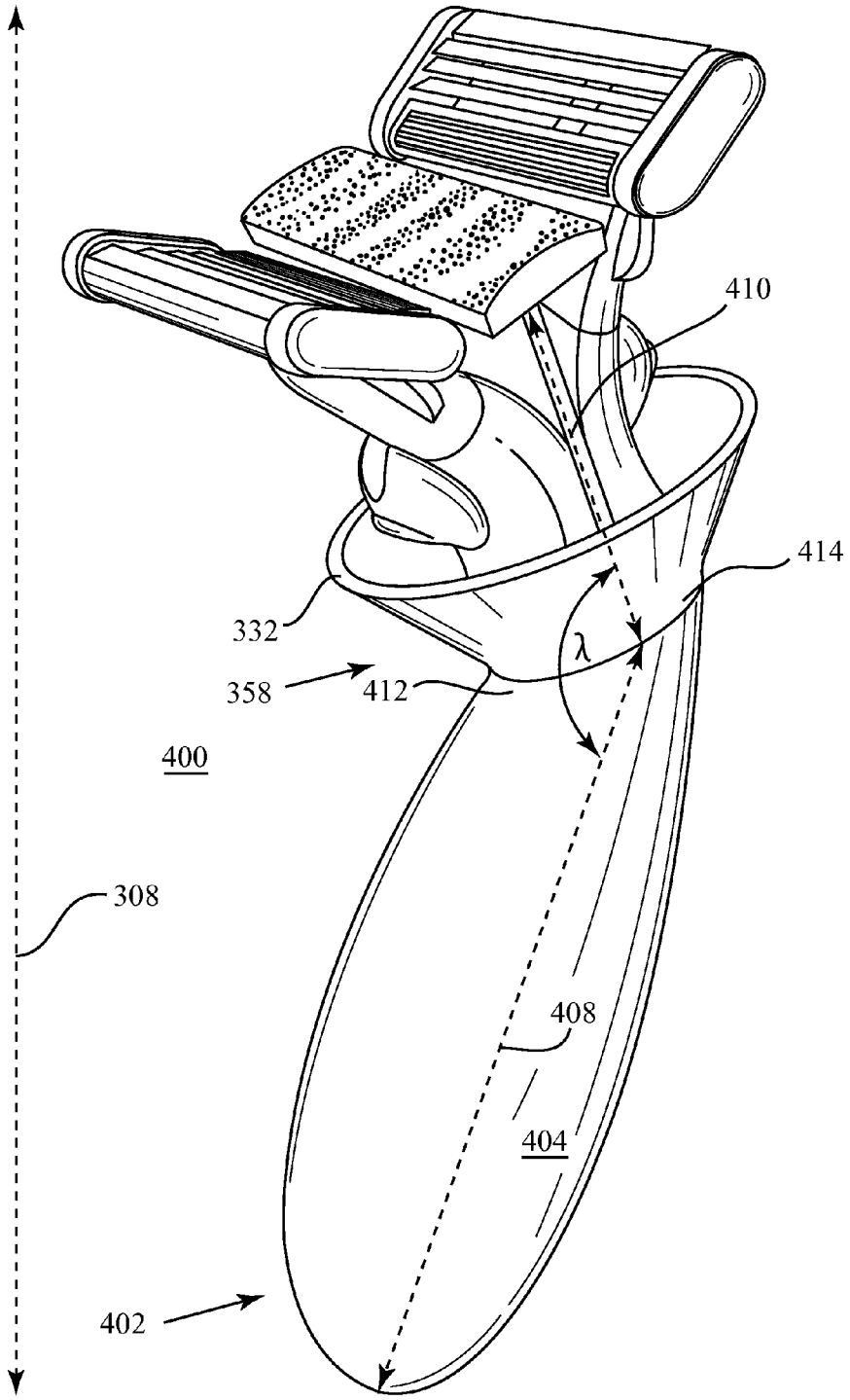
FIG. 4 is an exemplary illustration of a dual-head shaving device assembly using a friction/compression pad with a handle that has an elongated, substantially oval shaped grip portion in accordance with the present invention.

FIG. 4 is an exemplary illustration of a dual-head shaving device assembly using a friction/compression pad with a handle that has an elongated, substantially oval shaped grip portion in accordance with the present invention. The dual-head shaving device 400 illustrated in FIG. 4 includes similar corresponding or equivalent components, interconnections, and or cooperative relationships as the single-head shaving device 100 and the dual-head shaving device 300 that is shown in FIGS. 1A to 3E, and described above. Therefore, for the sake of brevity, clarity, convenience, and to avoid duplication, the general description of FIG. 4 will not repeat every corresponding or equivalent component and or interconnections that has already been described above in relation to the single-head shaving device 100 and the dual-head shaving device 300 that are shown in FIGS. 1A to 3E.

As illustrated in FIG. 4, the dual-head shaving device 400 includes handle 402 with an elongated, substantially oval shaped grip portion 404 with a central longitudinal axis 408, and the barrier portion 332 with a central longitudinal axis 410. As illustrated, the central longitudinal axis 408 of the grip portion 404 is at an angle $\lambda$ in relation to the central longitudinal axis 410 of the barrier portion 332. The illustrated handle configuration of the device 400 enables the user to grip the device 400 with the fingertips at the neck portion 358, close to the shaving heads. More particularly, the folded forefingers press against section 414, and the thumb presses against section 412 of the neck portion 358 to hold or grasp the handle for close control of the shaving device. The overall configuration of the handle 402 provides the familiar feel of the conventional T-handle of a conventional single head shaving devices, but with an overall shorter span, bulkier grip, a neck or waist portion, and a barrier, all of which enable a much greater control of the shaving device 400, combined with the advantages of a dual-head shaving device with a centered stand in accordance with the present invention.

Figure 5:
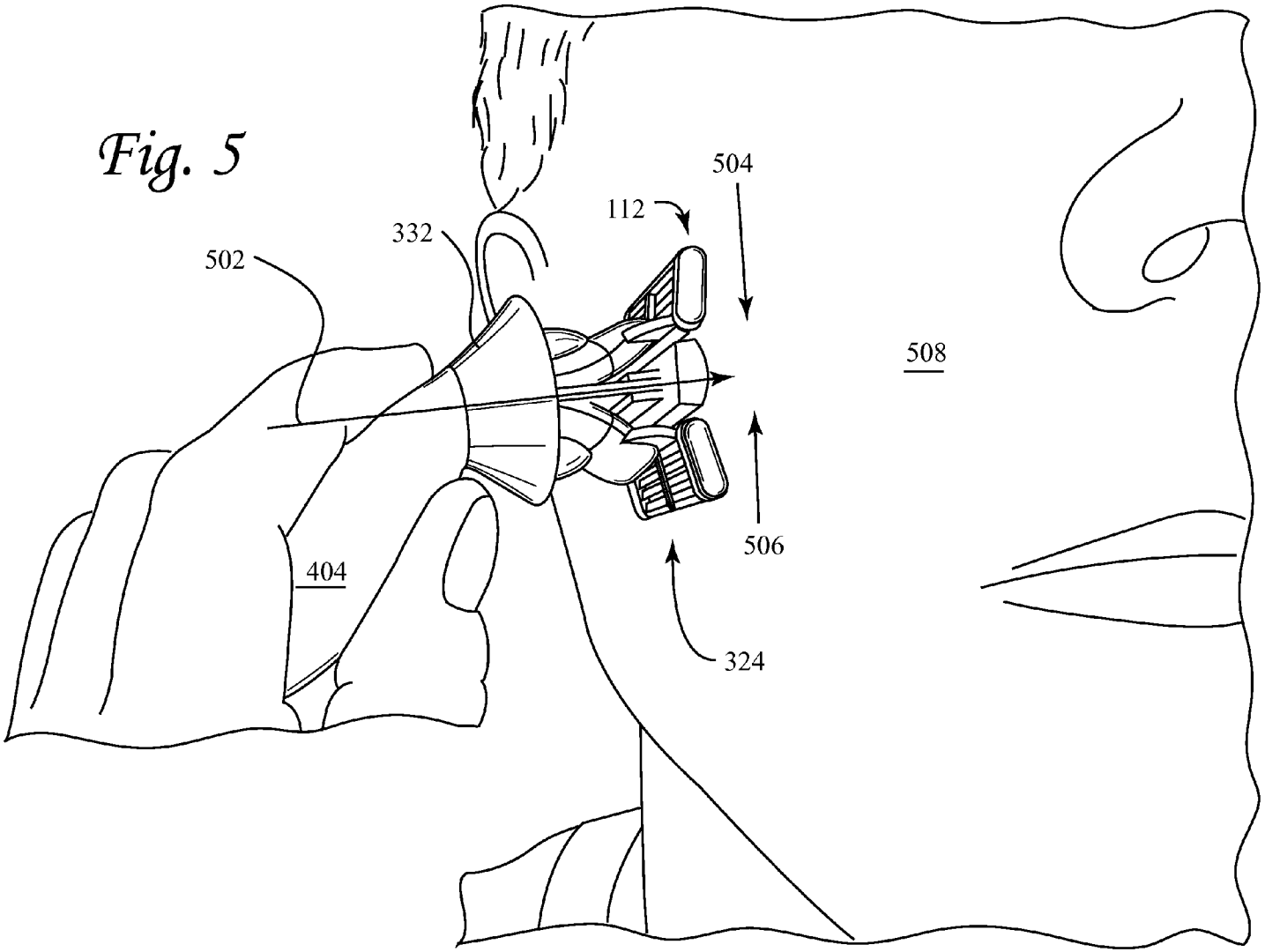
FIG. 5 is an exemplary illustration of a shaving device in use in accordance with the present invention.

FIG. 5 is an exemplary illustration of a shaving device in use in accordance with the present invention. It should be noted that the shaving device shown in FIG. 5 is meant as illustrative and for convenience of example only, and should not be limiting. In other words, it would be appreciated by those skilled in the art that instead of the exemplary device shown in FIG. 5, any one of the embodiments (e.g., shaving devices 100 and or 300) described and shown throughout the disclosure of the present invention could have been illustrated in FIG. 5.

As illustrated, during shaving, as the user presses the exemplary device 400 of the present invention against the skin 510 (illustrated by the arrow 502), the first and second razor blade heads 112 and 324 flatten to conform to the contour of the skin 510, and the friction pad 114 rests on the skin 510 between the first and second razor blade heads 112 and 324. As the user shaves in the direction indicated by the arrow 504, the friction pad 114 pulls and stretches the skin 510 so that the first razor blade head 112 (trailing blade) can shave more closely. At the same time, the skin 510 is compressed so that hair follicles protrude and can be shaved below the skin-level. The handle 402 with the narrow waist 358 and the wide grip 404 allows the user to grip the device 400 close to the first and second razor blade heads 112 and 324 and to apply pressure (indicated by the arrow 502) evenly to the first and second razor blade heads 112 and 324 and the friction pad 114 (which stretches and compresses the skin 510), enabling the first razor blade head 112 (the trailing head) to shave closer.

As the user shaves in the direction indicated by the arrow 506, the friction pad 114 pulls and stretches the skin 510 so that the second razor blade head 324 (the trailing head) can shave more closely. At the same time, the skin 510 is again compressed so that the hair follicles protrude and can be shaved below the skin-level. The handle 402 with the narrow waist 358 and the wide grip 404 allows the user to grip the device 400 close to the first and second razor blade heads 112 and 324 and to apply pressure (indicated by the arrow 502) evenly to the first and second razor blade heads 112 and 324 and the friction pad 114 (which stretches and compresses the skin 510), enabling the second razor blade head 324 (the trailing head) to shave closer, especially since it is now shaving "against the grain." The user can use the "scrubbing motion" and listen for the "scraping sound" to quickly identify areas where more stubble can be removed and to "scrub" until the "scraping sound" is no longer heard. At this point, the closest and smoothest possible shave has been achieved. It should be noted that the devices of the present invention can also be used to shave laterally as opposed to up-and-down. The action of shaving in multiple directions provides for the closest shave possible in the shortest amount of time. This is very useful in all shaving applications.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the stand 106 could be mounted rigidly as described or with the ability to rotate, vibrate, or move to conform to contours of the area being shaved. The stand 106 may also be comprised of various materials to commensurately vary friction against the skin, which would vary the amount by which the skin is stretched. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A bi-directional shaving device, comprising:

a plane of symmetry within which lies a principle longitudinal axis and an axis of symmetry, with the principle longitudinal axis perpendicular to the axis of symmetry;

a short handle having a central longitudinal axis;

a first and second razor blade heads pivotally coupled with the handle along a pivot axis, and include a respective set of first and second razor blades, with the set of first and second razor blades having sharp razor blade edges parallel the axis of symmetry, and pointed inwardly towards the plane of symmetry, while oriented at an acute angle relative to a working plane of the respective first and second razor blade heads, with the working plane substantially perpendicular to the plane of symmetry;

a center stand that includes a pad with sufficient surface area to comfortably compress and frictionally grip to tighten skin in relation to the working plane for smoother shave;

the pad has a cross-sectional profile that includes a substantially convex form-factor that extends in-between a lateral sides of the pad, the cross-sectional profile of the pad extending along a longitudinal axis of the pad, which is parallel the axis of symmetry;

the center stand is an independent and separate part, wherein the center stand is positioned within the plane of symmetry in between the first and second razor blade heads, and the center stand includes: the base on which the pad is coupled; and a support coupled with the base;

the base is comprised of a base length that is oriented transverse the principle longitudinal axis with sufficient expanse that spans an entire distance parallel between a first and second distal ends of the first and second razor blade heads;

the support is comprised of:

a top distal end that is wider than a bottom distal end, having a height that elevates the pad substantially parallel and flush with the working plane, above the pivot axis;

the support is laterally reinforced with first and second braces at the top distal end, with the first and second braces coupled with a bottom surface of the base and top distal ends of lateral surfaces of the support.

2. The bi-directional shaving device as set forth in claim 1, wherein:

the short handle includes:

a grip portion having a grip width that radially decreases along the central longitudinal axis of the handle, radially converging to a neck portion of the handle;

a barrier portion having a barrier width that radially increases along the central longitudinal axis of the handle, forming divergent, radially beveled flange wall;

the barrier portion limits and blocks a grip of fingertips at the neck portion of the handle to prevent and block the fingertips to move passed beyond the neck portion.

3. The bi-directional shaving device as set forth in claim 2, wherein:

the grip portion of the handle is arranged close to the pivoting first and second razor blade heads at the neck portion for greater control and feel in application of pressure parallel the principle longitudinal axis against the working plane, enabling a sense for additional stubble removal;

the grip portion enables moving the handle in a reciprocating motion so that the center stand and first and second razor blade heads are movable along the working plane on the skin, with the movement generally perpendicular to the applied pressure;

the center stand tightens the skin by a frictional pull on the skin as a result of the applied pressure, causing the skin to stretch and tighten to enable a trailing one of the first and second razor blade heads for closer shave;

the center stand further compresses the skin as a result of the applied pressure, compressing the skin below a level of existing hair growth, causing the hair follicles to protrude, which enables closer shave of the skin hair; and the center stand substantially fills a gap between the first and second razor blade heads to keep the skin flat and away from being caught and wedged in between the first and second razor blade heads to thereby diminish potential of cuts and nicks, especially during directional change;

whereby the center stand enable rapid back and forth slide of the first and second razor blade heads along the working plane of the skin in opposite short strokes, while maintaining the skin tight, the skin hair raised in a perpendicular orientation in relation to the working plane, and the skin flat to diminish cuts and nicks when changing shaving direction.

* * * * *